United States Patent [19]

Eckert

[11] 4,022,517

[45] May 10, 1977

[54] DISPLAY CASE FOR SMALL ARTICLES

[75] Inventor: Ronald P. Eckert, Northbrook, Ill.

[73] Assignee: Amity Leather Products Company, West Bend, Wis.

[22] Filed: Dec. 8, 1975

[21] Appl. No.: 638,704

[52] U.S. Cl. ..... 312/257 R; 312/223; 312/111; 312/107

[51] Int. Cl.[2] ..... A47B 43/00; A47B 87/00

[58] Field of Search ... 312/257 R, 257 SK, 257 SM, 312/257 A, 107, 223

[56] References Cited

UNITED STATES PATENTS

| | | | |
|---|---|---|---|
| 1,046,488 | 12/1912 | Pauley | 312/257 R |
| 1,282,833 | 10/1918 | Holder | 312/257 R |
| 1,701,806 | 2/1929 | Flanagan | 312/257 R |
| 2,104,912 | 1/1938 | Streeter | 312/107 |
| 2,104,913 | 1/1938 | Streeter | 312/107 |
| 2,460,469 | 2/1949 | Rifkin et al. | 312/223 |
| 2,692,790 | 10/1954 | Tharrington | 312/229 |
| 3,265,935 | 8/1966 | Rosa | 312/111 |
| 3,360,320 | 12/1967 | Lust | 312/257 R |
| 3,567,300 | 3/1971 | Mari | 312/257 R |
| 3,945,696 | 3/1976 | Yellin | 312/257 R |

FOREIGN PATENTS OR APPLICATIONS

| | | | |
|---|---|---|---|
| 1,164,566 | 1958 | France | 312/257 R |
| 742,341 | 1955 | United Kingdom | 312/257 R |

*Primary Examiner*—Paul R. Gilliam
*Assistant Examiner*—Victor N. Sakran
*Attorney, Agent, or Firm*—Wegner, Stellman, McCord, Wiles & Wood

[57] ABSTRACT

A knockdown display case for small articles has rectangular floor and top boards mounted on extruded aluminum corner posts that have parallel side webs at 45° to the edges of the boards engaged in notches in the boards, a connecting web which, with the side webs, defines a vertical, inwardly facing cavity for tubular lamps, and outward extensions on the side webs slidably receive a decorative strip that is parallel to the connecting web to define a wireway. Molded plastic end panels have vertical marginal portions extending outwardly at 135° and snugly held in bifurcations of two post side webs; and each end panel has several spaced horizontal rows of inwardly projecting, narrow rectangular lugs that define vertical slots. Horizontal article supporting shelves and inclined article supporting racks are supported on the lugs and have webs engaged in the slots. The display case is open at both sides and may have racks facing in opposite directions, and a center divider panel that may be used slides between parallel vertical flanges formed integrally with lugs on the vertical median plane of the end panels.

36 Claims, 10 Drawing Figures

FIG. 2
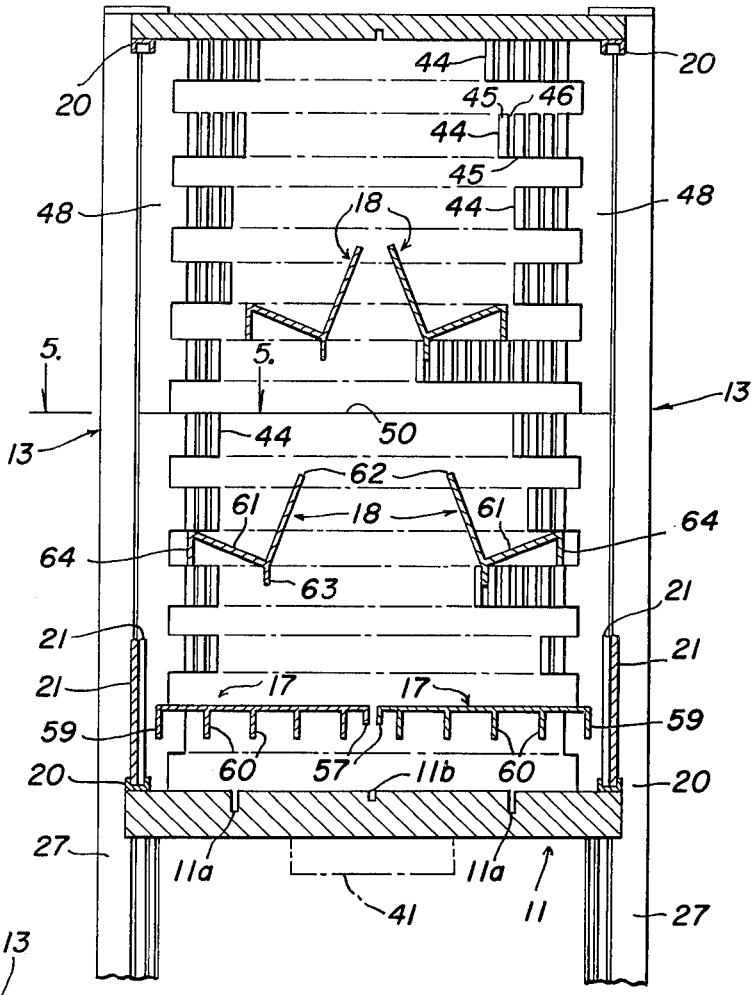
FIG. 5
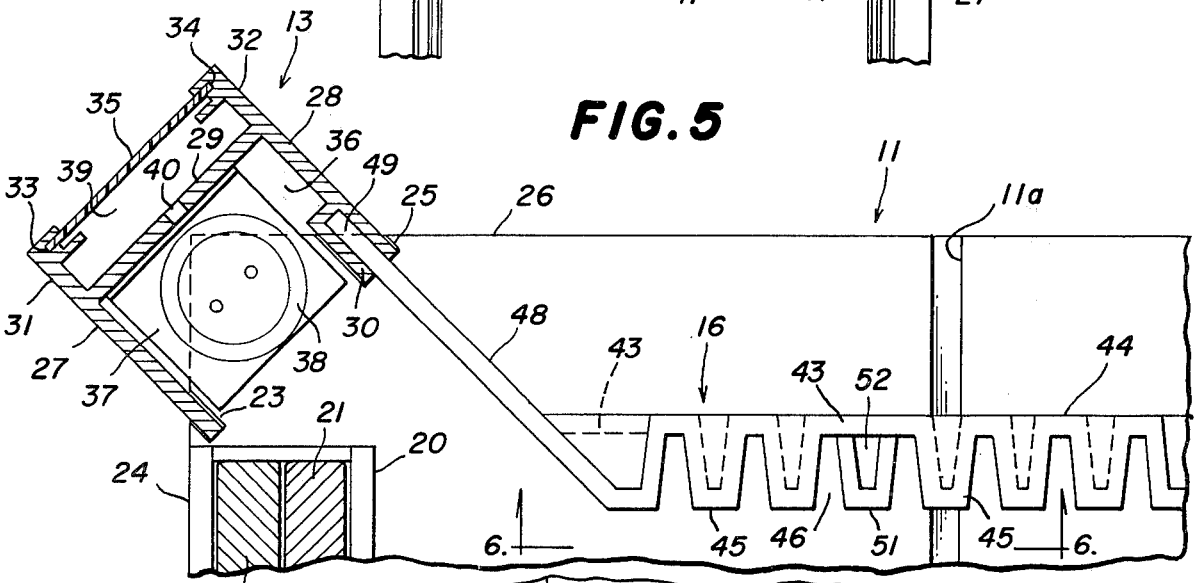
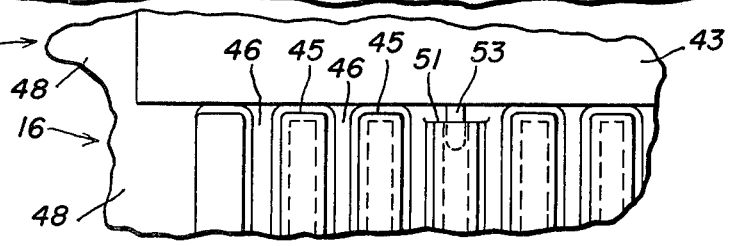
FIG. 6

DISPLAY CASE FOR SMALL ARTICLES

BACKGROUND OF THE INVENTION

Numerous efforts have been made to produce display cases for small articles, such as wallets and coin purses, which consist of a relatively small number of different kinds of parts that can be shipped knocked down, and that can be relatively easily assembled using simple tools such as screw drivers and pliers.

Further essential criteria of such a knockdown display case are that it be attractive, that it offer good interior illumination which is reasonably uniform, and that it permit some versatility in arrangement of its article supporting means. Likewise, of course, such cases must be provided with movable closures that can be locked if desired.

SUMMARY OF THE INVENTION

The principal object of the present invention is to provide a display case for small articles which consists of a relatively small number of different kinds of parts that can be shipped knocked down and that can be readily assembled where it is to be used.

Another object of the invention is to provide such a display case which presents an attractive appearance and which provides for good and reasonably uniform illumination of articles displayed in it.

Still another object of the invention is to provide such a display case which offers great versatility in interior arrangement of the article supporting means within it.

Yet another object of the invention is to provide a display case which may be arranged, selectively, either with all articles to be viewed from one side of the case, or with articles to be viewed from both sides of the case, and with or without a longitudinal divider panel.

Still another object of the invention is to provide a display case in which principal structural elements present an attractive appearance and at the same time are highly functional in the combination.

In particular, the display case includes extruded metal corner posts which have parallel sidewebs connected by a cross web, and the posts are assembled at 45° to the corners of a floor board and a top board of the display case with the sidewebs extending into slots in the edges of the boards. The sidewebs and the connecting cross web of the post define a vertical, inwardly open cavity which is large enough to receive tubular lamps which are preferably fluorescent; and the sidewebs extend outwardly past the connecting web and are provided with facing trackways at their outer extremities to slidably receive a decorative strip in parallel, spaced relationship to the connecting web. The sideweb extensions, the connecting web and the decorative strip define a wireway, and holes in the connecting web permit the wires in the wireway to be connected to lamp sockets in the inwardly facing vertical channel. In addition, one sideweb of each corner post is bifurcated to slidably receive a vertical edge portion of end panel means.

Each end panel means consists of a plurality of identical molded plastic end panels which have vertical marginal portions that extend outwardly at 135° to the plane of the end panel, and it is the edges of the angular vertical margins that are received in the bifurcated sidewebs of the posts.

Each of the plastic end panels has several vertically spaced, horizontal rows of inwardly projecting, narrow rectangular lugs which define vertical slots; and the space between adjacent rows of lugs defines identical horizontal channels. In addition to serving the function of carrying article supporting means, the rows of lugs provide an attractive geometric design both interiorly and exteriorly of the end panels.

Each end panel has a row of lugs along its upper margin, and some of the lugs in the row have open tops, and at the lower end of each panel is a plurality of integral, downwardly extending studs which are offset inwardly of the plane of the panel so as to be received in the open tops of the several lugs in the next lower end panel.

In addition, the lugs on the vertical median plane of each end panel are provided with inwardly extending parallel flanges that are small enough to be entirely unobtrusive but that project inwardly far enough to slidably receive the end portions of a plurality of longitudinal divider panels which may be utilized if desired to divide the interior of the display case into halves.

The display case includes two types of article supporting means, one of which is flat shelves and the other of which is tilted racks. The ends of both the shelves and the racks are supported upon aligned rows of lugs on the opposite end panels and both the shelves and the racks have depending rear and front flanges. The rear flanges of the shelves and the racks engage a vertical slot. The front flange on a shelf overhangs the row of lugs upon which the shelf is supported; while the front flange of a rack stands upon the lugs, thereby giving the rack its tilted disposition in the case.

The racks are shallow enough that two of them may be arranged back to back on opposite sides of the vertical median plane of the case with lower racks farther apart than the upper racks for maximum visibility of articles displayed on ail of the racks.

The flat shelves, in addition to the rear flanges and frong flanges, have intermediate flanges which serve a strengthening function and which also are received in the vertical slots defined by the lugs of the rows on which the shelf is supported.

THE DRAWINGS

FIG. 2 is a transverse sectional view taken substantially as indicated along the line 2—2 of FIG. 1 with many of the lugs in the end panels omitted for clarity of illustration;

FIG. 5 is a fragmentary sectional view on an enlarged scale taken substantially as indicated along the line of 5—5 of FIG. 2;

FIG. 6 is a fragmentary elevational view of a portion of an end panel taken substantially as indicated along the line 6—6 of FIG. 5;

DETAILED DESCRIPTION OF THE INVENTION

Figure 1:
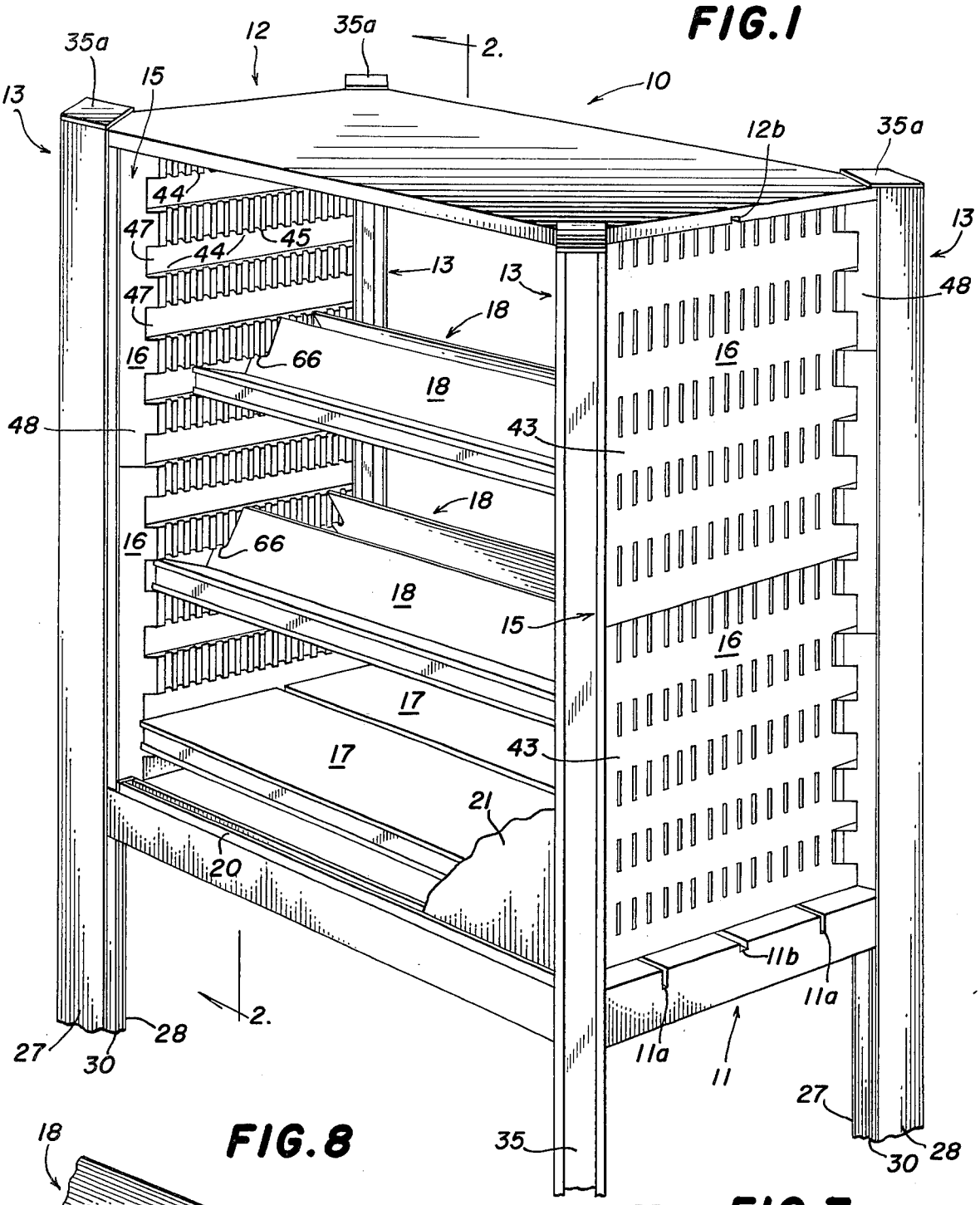
FIG. 1 is a perspective view of a display case embodying the invention, with most of a slidable front closure broken away to clearly illustrate the interior of the case.

Referring to the drawings in detail, and referring first to FIG. 1, the display case of the present invention, indicated generally at 10; includes a rectangular bottom board, indicated generally at 11; a rectangular top board, indicated generally at 12; four extruded aluminum corner posts, each indicated generally at 13; end panel means, indicated generally at 15, each of which consists of two identical end panels, each of which is indicated generally at 16; and article supporting shelf means consisting of horizontal shelves, each of which is indicated generally at 17, and tilted shelf racks, each of which is indicated generally at 18.

Figure 3:
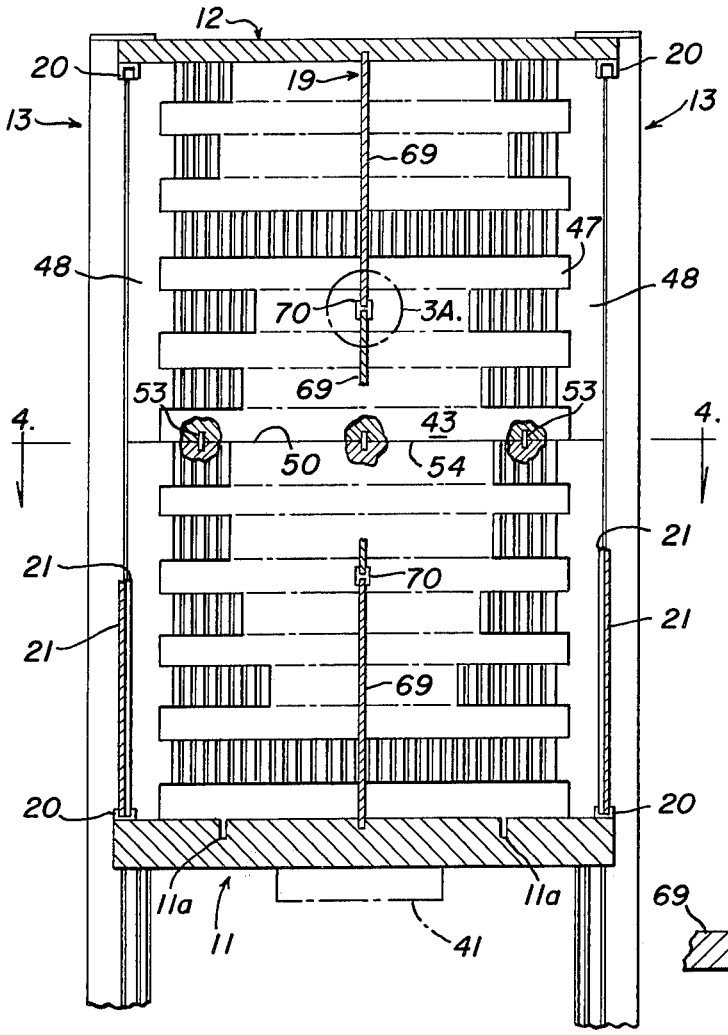
FIG. 3 is a view similar to FIG. 2 with the article supporting means omitted and with a longitudinal divider panel inserted, parts of the end panels being illustrated in section to shown the interconnection between panels.
Figure 4A:
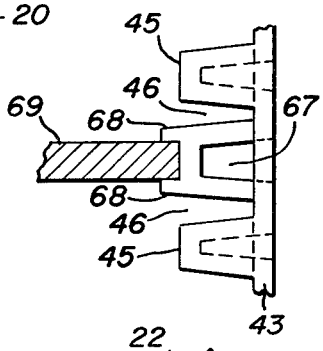
FIG. 4A is an enlarged sectional view of the portion of FIG. 4 which is enclosed within the broken circle and shows the connection between an end of a divider panel and an end panel.
Figure 4:
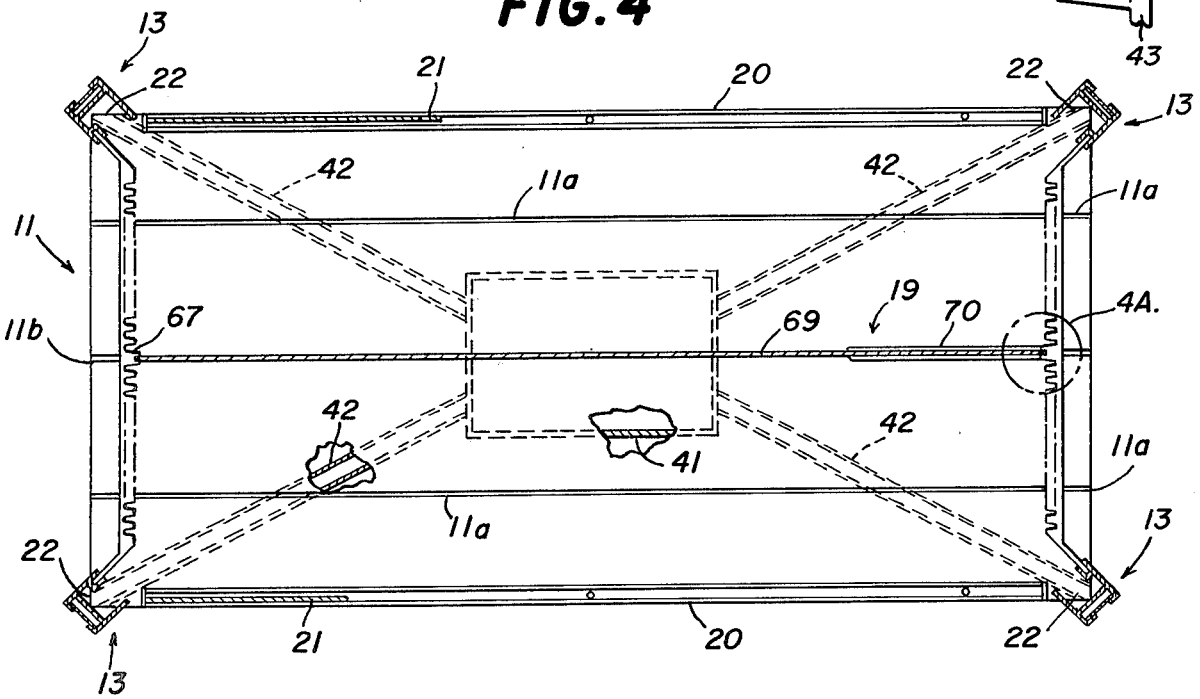
FIG. 4 is a horizontal sectional view taken substantially as indicated along the line 4—4 of FIG. 3 with parts broken away.

When desired, the display case may be provided with longitudinal divider panel means, indicated generally at 19 in FIGS. 3 and 4; and preferably, although not necessarily, tracks 20 (FIGS. 2 to 6) are mounted along the longitudinal margins of the bottom board 11 and the top board 12 to receive double sliding doors 21. The tracks 20 and doors 21 are conventional, and commonly are provided with locks for safeguarding the articles displayed in the case.

Referring now particularly to FIGS. 4 and 5, adjacent each of the corners 22 of the bottom board 11 slots 23 are cut into the longitudinal margin 24 of the board, and slots 25 are cut into the transverse margin 26 of the board, said slots adjacent each corner being parallel to one another. The top board 12 is provided with slots (not shown) which are positioned directly above the slots 23 and 25 when the case is assembled.

Each of the corner posts 13 is best seen in FIG. 5 to have parallel side webs 27 and 28 and a connecting cross web 29; and when the case is assembled the post sidewebs 28 are received in the slot 23 of the bottom board 11 and in the corresponding slots of the top board 12; while the sidewebs 28 are received in the slots 25 of the bottom board and in the corresponding slots of the top board. The post sideweb 28 is bifurcated as seen at 30 to receive the vertical edge portions of the end panels 16. The post sidewebs 27 and 28 have extensions 31 and 32, respectively, the outer end portions of which are provided with confronting trackways 33 and 34, respectively, in which decorative strips 35 are slidably mounted.

The sidewebs 27 and 28 and the connecting web 29 define an inwardly open vertical channel 36 in which angle brackets, such as the bracket 37 are mounted, to receive sockets, such as the socket 38, for tubular lamps which are preferably fluorescent to minimize heating of the corner post 13. In addition, the connecting web 29, the sideweb extensions 31 and 32, and the decorative strip 35 form a vertical enclosure which serves as a wireway 39, and holes 40 in the connecting web 29 permit wires (not shown) in the wireways to be connected to the lamp sockets in the channel 36. Decorative end caps 35*a* surmount the posts 13; and the lower ends of the posts are provided with conventional adjusting screws and feet (not shown).

As best seen in FIG. 4, a wiring box 41 is fastened beneath the bottom board 11, and armored cables 42 carry wires from the wiring box 41 into the wireways 39.

The bottom board 11, the top board 12, and the corner posts 13 are secured together by conventional brackets and bolts or screws and provide a cabinet structure having end openings which are closed by the end panel means that is formed by the end panels 16.

The end panels 16, which are plastic moldings, are best seen in FIGS. 1, 2, 5 and 6 to consist of a planar body sheet 43 which is provided with a plurality of horizontal rows 44 of inwardly projecting rectangular lugs 45 which are quite narrow, and adjacent lugs 45 define narrow vertical slots 46. Adjacent rows 44 of lugs 45 define horizontal channels 47; and as seen in FIG. 5 the vertical marginal portions 48 of the end panels 16 extend diagonally outwardly at an angle of 135° to the planar panel body 43, and it is the edge portions 49 of said vertical marginal portions 48 that are received in the bifurcations 30 of the post sidewebs 28.

Referring now particularly to FIGS. 3 and 5, one of the horizontal rows 44 of inwardly projecting rectangular lugs 45 runs along the top margin 50 of the end panel 16, and some of the rectangular lugs, one of which is indicated at 51 in FIGS. 5 and 6, have open upper ends providing cavities 52. A stud 53 corresponding to each cavity 52 extends downwardly from the lower margin 54 of each end panel 16 into said cavities 52 so that a plurality of the end panels 16 may be stacked edge to edge and retained in register by engagement of the studs 53 in the cavities 52. The studs 53 are molded integrally with the end panels, and as is apparent from FIGS. 5 and 6 they must be offset inwardly from the plane of the panel body 43 so as to engage in the cavities 52. Grooves in bottom board 11 receive the studs 53.

A feature of the end panels 16 is that they may be formed with the inwardly projecting lugs 45 open toward the outer surface of the end panels 16 which, as seen in FIG. 1, affords a somewhat decorative geometric pattern which is visible from the ends of the display case; and by making the end panels 16 of colored transparent or translucent plastic, the interior lighting afforded by the fluorescent tubes in the posts 13 can afford a most striking visual effect which draws attention to the display case and its contents. Although the drawings show that each end panel means consists of two end panels 16, with a total of ten rows 44 of lugs, it is obvious that each panel might have more or less such rows. Thus, three panels of four rows each would provide a "12 high" display case.

Figure 8:
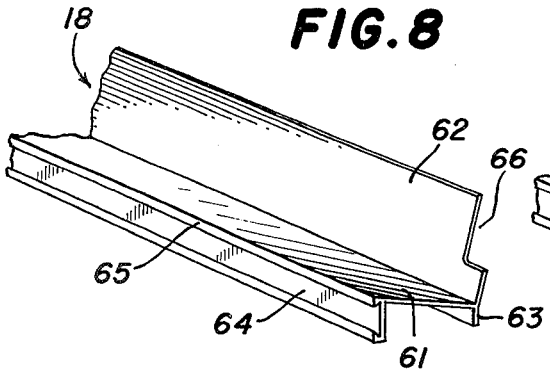
FIG. 8 is a fragmentary perspective view of an article supporting rack.
Figure 7:
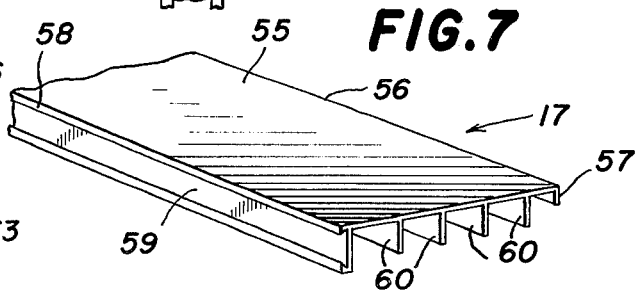
FIG. 7 is a fragmentary perspective view of a horizontal article supporting shelf.

Referring now particularly to FIGS. 2, 7 and 8, the horizontal shelves 17 and the inclined racks 18 which constitute the article supporting means of the display case are also preferably plastic moldings. Referring first to FIGS. 2 and 7, each of the horizontal shelves 17 includes a supporting sheet 55 which has at its rear edge 56 a continuous, depending web 57; and along the front 58 of the sheet 55 is a depending front web 59. Preferably there are also a plurality of intermediate webs 60; and the spacing between the webs 57 and 60 and between the webs 60 and 59 is such that, as seen in FIGS. 1 and 2, a horizontal shelf 17 has the ends of its sheet 55 resting upon the lugs 45 of a row of lugs 44 with the webs 57 and 60 engaged in certain of the vertical slots 46, and the depending front flange 59 overhanging the rows 44 of lugs upon which the shelf 17 is supported.

Referring now particularly to FIGS. 1, 2 and 8, each of the racks 18 is seen to include a floor 61 and a back 62 which are at right angles to one another; and a continuous depending rear web 63 extends along the angle of the floor 61 and the back 62. Likewise, a continuous depending front web 64 which is parallel to the rear web 63 extends along the forward margin 65 of the rack floor 61. As best seen in FIG. 2, each of the racks 18 has its end extremities extending into one of the horizontal channels 47, and the depending rear web 63 engages a vertical slot 46 while the depending front web 59 stands on top of a pair of the lugs 45 so that the racks 18 are supported on the lugs 45 in the desired tilted position. As seen in FIG. 8, each end of the back 62 is cut away at 66 so that the lower portion of the back extends into the channel 47 while the upper portion is between the lugs of rows 44 of the two end panels 16 above the rows upon which the rack is supported. In order that racks 18 may be placed upon the bottom board 11, said board is provided with longitudinal slots 11*a* to receive the rear webs 63 of two racks 18 the front webs 64 of which are close to the tracks 20.

As seen in FIG. 2, both of the article supporting means 17 and 18 have a front to rear dimension which is less than one-half the depth of the display case 10, so that they may be mounted upon opposite sides of the longitudinal, vertical median plane of the case. The racks 18, in particular, are seen in figure to be of a depth which is substantially less than one-half the depth of the display case, so that two of the racks 18 may be mounted at an upper level in the case in back-to-back positions very close to the vertical median plane, while two racks 18 at a lower level are farther apart.

The several rows 44 of lugs 45, coupled with the narrowness of the lugs 45 which places the vertical slots 46 very close together, permits racks 18 and shelves 17 to be mounted in almost any location which a particular person finds desirable. While the display case will ordinarily be used so that it may be viewed from both sides, it may be provided with opaque back panels to replace two of the sliding doors, and the racks 18 may be disposed in a stepped arrangement facing the front.

Figure 3A:
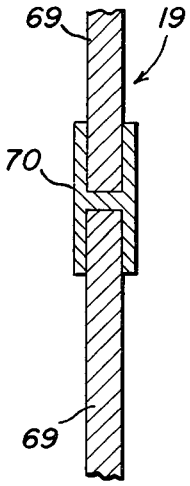
FIG. 3A is a fragmentary enlarged sectional view illustrating the connection between divider panels seen in the broken line circle of FIG. 3.

In order that the display case may be provided with longitudinal divider means 19, the floor board 11 and the top board 12 have longitudinal slots 11*b* and 12*b* on their respective longitudinal median planes, and each of the end panels 16 has a row of lugs 67 on its vertical median plane which are provided with inwardly extending short, parallel flanges 68. Longitudinal divider panel means 19 consists of a plurality of panels 69 which are stacked vertically edge to edge with their end margins slidably received between the parallel flanges 68. The lower marginal portion of the lowermost panel 69 seats in the floor board slot 11*b*, while the upper margin of the uppermost panel 69 seats in the top board slot 12*b*. As seen in FIG. 3A, the adjacent margins of divider panels 69 are received in connectors 70 which extend continuously along the longitudinal edges of the panels and are H-shaped in cross section to provide opposed slots in which the adjacent longitudinal edges of the panel 69 are held in alignment.

The foregoing detailed description is given for clearness of understanding only and no unnecessary limitations should be understood therefrom, as modifications will be obvious to those skilled in the art.

I claim

1. A display case for small articles comprising, in combination:

a cabinet which includes four corner posts, and a floor and a top which are of predetermined width from front to rear, said posts, floor and top defining end openings;

molded plastic end panel means at each end of said cabinet closing said end openings, each of said end panel means having a plurality of vertically spaced, horizontal rows of inwardly projecting, integral, closely spaced lugs, the lugs in each row defining a series of closely spaced vertical slots and said lugs and slots in one end panel means being aligned with those in the other end panel means, the lugs and slots in each of said horizontal rows defining means for supporting shelf means which may be of various widths and for restraining said shelf means against front to rear movement, whereby a plurality of such shelf means which are substantially narrower than the cabinet may be supported at different levels and with said narrower shelf means at different distances from the front of the cabinet;

and a plurality of shelf means extending between said end panel means and supported on aligned lugs therein, each said shelf means having first depending web means seated in aligned slots to restrain said shelf means, and having depending second web means.

2. The combination of claim 1 in which at least one shelf means comprises a horizontal shelf which has first web means at the rear and second web means at the front which overhangs the lugs in a row, and said horizontal shelf having at least one depending intermediate web means that seats in aligned slots.

3. The combination of claim 1 in which the front web means, the rear web means, and the intermediate web means all extend continuously from end to end of the horizontal shelf.

4. The combination of claim 1 in which at least one shelf means comprises a rack which has a floor and a back generally at right angles to one another, the first depending web means is at the juncture of said floor and back and said juncture rests upon two aligned lugs, and the second web means is at the front and rests upon two aligned lugs so as to support said rack with its floor and back in a rearwardly tilted position.

5. The combination of claim 4 in which the front web means extends continuously from end to end of the rack.

6. The combination of claim 5 in which the rear web means extends continuously from end to end of the rack.

7. The combination of claim 1 in which the shelf means includes, at least one rack supported on lugs toward the top of the end panel means, said rack having a floor and a back generally at right angles to one another, the first depending web means is at the juncture of said floor and back and said juncture rests upon two aligned lugs, and the second web means is at the front and rests upon two aligned lugs so as to support said rack with its floor and back in a rearwardly tilted position.

and in which said shelf means also includes at least one horizontal shelf supported on lugs below said rack, said horizontal shelf having its depending first web means at the rear and its second web means at the front overhanging the lugs on which it is supported.

8. The combination of claim 1 in which each end panel means comprises a plurality of end panels stacked edge to edge, each of said panels having at least one integral stud along one horizontal edge which is offset inwardly from the inner face of the panel so as to be in a plane parallel to said face, and in which there is an inwardly extending integral lug at the other horizontal edge which is vertically aligned with each stud, each lug having a transverse face provided with an opening to receive a stud of the next adjacent panel.

9. The combination of claim 8 in which said lug at the other horizontal edge is included in one of the horizontal rows of lugs.

10. The combination of claim 9 in which only said lug has a transverse face provided with an opening.

11. The combination of claim 1 in which the cabinet is open along both sides, the width of each article supporting means is less than one-half the front-to-rear depth of the cabinet, and in which each row of lugs on the end panel means includes a lug which is on the vertical median plane of the cabinet to provide a vertical set of lugs on said median plane, the lugs of said set are provided with parallel, inwardly extending vertical flanges, and divider panel means extends from end to end of the cabinet and has its end extremities slidably received between said parallel, vertical flanges.

12. The combination of claim 11 in which the divider panel means comprises a plurality of divider panels stacked edge to edge, and in which connectors extend from end to end of the horizontal edges of said panels, said connectors being H-shaped in cross section so as to provide oppositely facing grooves that receive the adjacent horizontal edge portion of adjacent divider panels.

13. The combination of claim 11 in which the floor and the top have aligned slots along their longitudinal median planes, and in which the lower and upper longitudinal marginal portions of the divider panel means are received in said aligned slots.

14. The combination of claim 1 in which each of the corner posts has side webs and a connector web, the side webs are received in slots in the longitudinal and transverse margins of the floor and the top, and the post side webs which are received in slots in the transverse margins and bifurcated to snugly receive vertical edge portions of the end panel means.

15. The combination of claim 14 in which the side webs in each corner post are parallel and the corners of the floor and the top extend into the space between the side webs at angles of 45° to said side webs.

16. The combination of claim 15 in which each end panel means has vertical marginal portions which extend outwardly at 135° angles to the plane of said end panel means, and the edges of said marginal portions are received in the bifurcated post side webs.

17. The combination of claim 14 in which the side webs and the connecting web define an inwardly open vertical cavity, and sockets for tubular lamps are mounted in said cavity.

18. The combination of claim 17 in which the side webs have extensions which project outwardly past the connecting web, said extensions have facing trackways at their outer extremities to slidably receive a decorative panel which is substantially parallel to the connecting web, and in which the connecting web has a hole so that the space defined by said extensions, the connecting web and the decorative panel provides a wireway from which electrical wires may be connected to the tubular lamp sockets through said hole.

19. The combination of claim 1 in which the vertically spaced, horizontal rows of lugs on the end panels define horizontal channels which are bounded by the lugs of adjacent rows, and in which at least one shelf means comprises a rack which has a floor and a back generally at right angles to one another, the first depending web means is at the juncture of said floor and back and said juncture rests upon two aligned lugs, and the second web means is at the front and rests upon two aligned lugs so as to support said rack with its floor and back in a rearwardly tilted position, the extremities of said front web means, of said rack floor, and of the lower portion of said back projecting into one of said horizontal channels, and the extremities of the back being recessed to accommodate the lugs of the row that bounds the top of said one channel.

20. The combination of claim 1 in which the cabinet is open along both sides, the width of each shelf means is less than one-half of the front-to-rear depth of the cabinet, in which at least two of said shelf means comprise racks which have an inclined rack floor and a back at substantially right angles to one another, and in which pairs of said racks are mounted back to back on opposite sides of the vertical median plane of the cabinet.

21. The combination of claim 20 in which the width of the racks is substantially less than one-half of the front-to-rear depth of the cabinet, a first pair of racks is supported on upper rows of lugs with their backs close to the longitudinal median plane of the cabinet, and a second pair of racks is supported on rows of lugs below said first pair of racks with their backs farther from said median plane than are the backs of said first pair of racks.

22. The combination of claim 1 in which the end panel means are of effectively uniform thickness throughout their areas, including the areas occupied by the lugs, and the outer faces of said end panel means are exposed so that the rear of said lugs forms a visible geometric pattern of recesses.

23. The combination of claim 22 in which the lugs are narrow and rectangular.

24. The combination of claim 1 in which the vertically spaced rows of lugs on the end panels define identical horizontal channels, the ends of the shelf means are positioned in said channels, and the height of the depending first web means and of the depending second web means is less than the height of a channel.

25. The combination of claim 1 in which the lugs are narrow and rectangular.

26. A knockdown display case for small articles comprising in combination:

a rectangular floor board which has slots in its longitudinal and transverse margins close to each of its corners;

a rectangular top board which is of the same dimensions as said floor board and has slots that are vertically aligned with those in the floor board;

four corner posts each of which has side webs engaged in the slots in said boards adjacent one of said corners, each of said posts having a connecting web between said side webs, and the post side webs that are engaged in the slots in the transverse margins of said boards being bifurcated;

removable means fixedly connecting said posts to said boards;

identical end panel means filling the space between said boards along both transverse margins of the boards, each said end panel means having vertical edge portions snugly received in two of said bifurcated post side webs, and each of said end panel means being provided with a plurality of vertically spaced rows of spaced, inwardly extending lugs which define vertical slots;

and a plurality of article supporting means extending between said end panel means and supported on aligned lugs therein, each said article supporting means having depending first web means seated in aligned slots, and having depending second web means.

27. The combination of claim 26 in which the side webs in each corner post are parallel and the corners of the floor and the top extend into the space between the side webs at angles of 45° to said side webs.

28. The combination of claim 27 in which each end panel means has vertical marginal portions which extend outwardly at 135° angles to the plane of said end panel means, and the edges of said marginal portions are received in the bifurcated post side webs.

29. The combination of claim 23 in which the side webs and the connecting web define an inwardly open vertical cavity, and sockets for tubular lamps are mounted in said cavity.

30. The combination of claim 29 in which the side webs have extensions which project outwardly past the connecting web, said extensions have facing trackways at their outer extremities to slidably receive a decorative panel which is substantially parallel to the connecting web, and in which the connecting web has a hole so that the space defined by said extensions, the connecting web and the decorative panel provides a wireway from which electrical wires may be connected to the tubular lamp sockets through said hole.

31. The combination of claim 26 in which each end panel means comprises a plurality of end panels stacked edge to edge, each of said panels having at least one integral stud along one horizontal edge which is offset inwardly from the inner face of the panel so as to be in a plane parallel to said face, and in which there is an inwardly extending integral lug at the other horizontal edge which is vertically aligned with each stud, each lug having a transverse face provided with an opening to receive a stud of the next adjacent panel.

32. The combination of claim 26 in which the cabinet is open along both sides, the width of each article supporting means is less than one-half the front-to-rear depth of the cabinet, and in which each row of lugs on the end panel means includes a lug which is on the vertical median plane of the cabinet to provide a vertical set of lugs on said median plane, the lugs of said set are provided with parallel, inwardly extending vertical flanges, and divider panel means extends from end to end of the cabinet and has its end extremities slidably received between said parallel, vertical flanges.

33. The combination of claim 32 in which the divider panel means comprises a plurality of divider panels stacked edge to edge, and in which connectors extend from end to end of the horizontal edges of said panels, said connectors being H-shaped in cross section so as to provide oppositely facing grooves that receive the adjacent horizontal edge portion of adjacent divider panels.

34. In a display case for small articles which includes a rectangular floor, a rectangular top, and end panels mounted between the ends of said floor and said top, an improved extruded corner post comprising, in combination:

parallel side webs and a connecting web therebetween, one of said side webs engaging aligned slots in the transverse margins of the floor and the top, and the other of said side webs engaging aligned slots in the longitudinal margins of said floor and top, and said webs defining a vertical lamp receiving channel that faces into said display case at substantially a 45° angle;

and a bifurcation along the extremity of said one of said webs, said bifurcations in the posts at one end of the display case receiving the vertical edge portions of the end panel at said one end of the case.

35. The combination of claim 34 in which the side webs have extensions which project outwardly past the connecting web, said extensions have facing trackways at their outer extremities, a decorative strip is slidably mounted in said trackways and with said extensions and connecting web defines a wireway, and in which the connecting web is provided with holes through which electrical connections may be made between wires in the wireway and lamps in the channel.

36. In a display case for small articles which includes a rectangular floor, a rectangular top, corner posts secured to said floor and top, and end panels which are mounted between the posts and close the space between the floor and the top, the improvement comprising, in combination:

said corner posts have parallel side webs and a connecting web which define a vertical lamp receiving channel that faces into the display case at substantially a 45° angle;

and said end panels are fabricated from light transmitting sheet material and have geometric patterns of moulded inwardly extending integral lugs defining a series of closely spaced slots so that said lugs and slots may support shelf means, whereby light projected into the display case by lamps in said channels is visible through said end panels and through said geometric patterns of moulded, inwardly extending lugs, in a visually attractive pattern of light of varying intensities.

* * * * *